US005713161A

United States Patent [19]

Veldhoen

[11] Patent Number: 5,713,161

[45] Date of Patent: Feb. 3, 1998

[54] NOISE-PROTECTION SCREEN

[75] Inventor: Arend Johan Veldhoen, Raalte, Netherlands

[73] Assignee: Durisol Materials Limited, Hamilton, Canada

[21] Appl. No.: 530,337

[22] PCT Filed: Feb. 3, 1995

[86] PCT No.: PCT/NL95/00052

§ 371 Date: Mar. 18, 1996

§ 102(e) Date: Mar. 18, 1996

[87] PCT Pub. No.: WO95/21300

PCT Pub. Date: Aug. 10, 1995

[30] Foreign Application Priority Data

Feb. 4, 1994 [NL] Netherlands ..... 9400173

[51] Int. Cl.[6] ..... E04B 1/82

[52] U.S. Cl. ..... 52/144; 52/566; 52/275; 405/284; 405/286; 256/13.1

[58] Field of Search ..... 52/144, 169.4, 52/169.2, 275, 561, 566; 404/6; 256/13.1, 19; 405/284, 286

[56] References Cited

U.S. PATENT DOCUMENTS

| | | | |
|---|---|---|---|
| 3,550,332 | 12/1970 | Wiesman | 52/144 X |
| 3,738,447 | 6/1973 | Rose | 52/144 X |
| 3,878,032 | 4/1975 | Larsson | 52/144 X |
| 3,948,009 | 4/1976 | Bernhard | 52/144 |
| 4,226,299 | 10/1980 | Hansen | 52/144 X |
| 4,317,503 | 3/1982 | Soderquist et al. | 52/144 X |
| 4,751,893 | 6/1988 | Brantley | 256/13.1 X |
| 4,785,577 | 11/1988 | Lederbauer | 256/13.1 X |
| 4,923,339 | 5/1990 | Smith | 405/284 |

*Primary Examiner*—Lanna Mai

*Attorney, Agent, or Firm*—Patrick J. Hofbauer

[57] ABSTRACT

A noise-protection screen (1) provided with a number of sound-damping elements (2) and over the length of the noise-protection screen, spaced at a distance from each other with girders for the support of the elements, and a sound-damping element for a noise-protection screen. The noise-protection screen includes an air cavity (8) delimited at one side by the sound-damping elements (2) and at the other side by panel-like elements (9). At the side of the sound-damping elements the air cavity is preferably in contact with the surroundings by means of air openings, preferably in the form of air gaps running longitudinally along the noise-protection screen.

7 Claims, 1 Drawing Sheet

NOISE-PROTECTION SCREEN

The invention relates to a noise-protection screen, provided with a number of sound-damping elements and over the length of the noise-protection screen, spaced at a distance from each other girders for the support of the elements, as well as to a sound-damping element for a noise-protection screen.

various embodiments of noise-protection screens or noise-protection walls are known. Applicants bring a noise-protection wall on the market under the name of Dumex, of which the sound-damping elements consist of a layer of reinforced concrete provided on one or both sides with a layer of wood fibre concrete.

The objective of the invention is in the first place to provide a noise-protection screen with improved sound-damping properties.

To this end the noise-protection screen according to the invention is characterized in that the noise-protection screen comprises an air cavity delimited at one side by the sound-damping elements and at the other side by panel-like elements.

In this way a noise-protection screen is obtained having excellent sound-damping properties, especially in the low frequency range.

The air cavity preferably is at the side of the sound-damping elements in contact with the surroundings by means of air holes, preferably in the form of air gaps running longitudinally along the noise-protection screen. In this way the air cavity acts as a resonator whereby excellent sound absorption is achieved. By choosing the appropriate dimensions for the air cavity and the air holes the sound absorption effect of the air cavity can be adjusted to the desired frequency range. The sound absorbing properties of the noise-protection screen according to the invention are thus obtained by the sound-damping elements and the air cavity acting as resonator.

Another objective of the invention is to provide a sound-damping element which can advantageously be used in the noise-protection screen according to the invention. The sound-damping element according to the invention is characterized in that its total thickness is built up of wood fibre concrete.

In this manner a sound-damping element is obtained having a weight considerably lower than that of the conventional sound-damping elements. This greatly simplifies the handling of the elements, such as during transport and assembly. Further, the important advantage is gained that it suffices to apply less extensive foundations. Both sides of the sound-damping element according to the invention are absorbent. As the total thickness of the sound-damping element consists of absorbent material a high degree of sound absorption is achieved. Moreover, the fabrication of such a sound-damping element made from one type of material is relatively simple, keeping fabrication costs lower.

According to the invention it is therefore preferred to apply these sound-damping elements.

The invention will be further elucidated with the aid of the drawing, Showing an embodiment of the noise-protection screen with sound-damping elements according to the invention.

Figure 1:
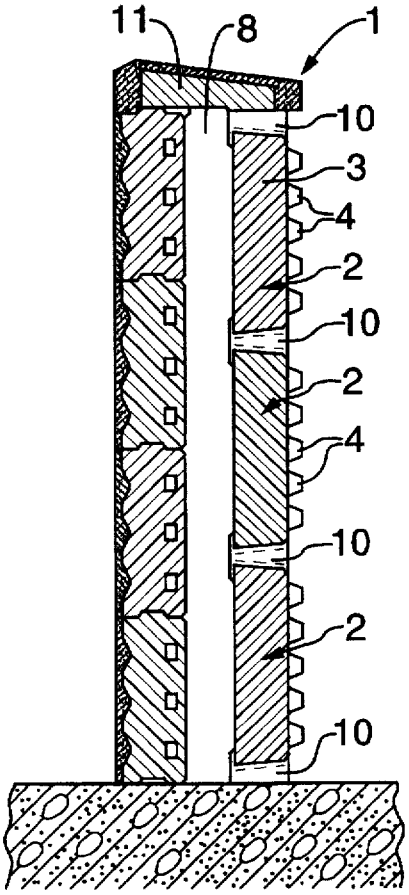
FIG. 1 is a vertical section of an embodiment of the noise-protection screen according to the invention.
Figure 3:
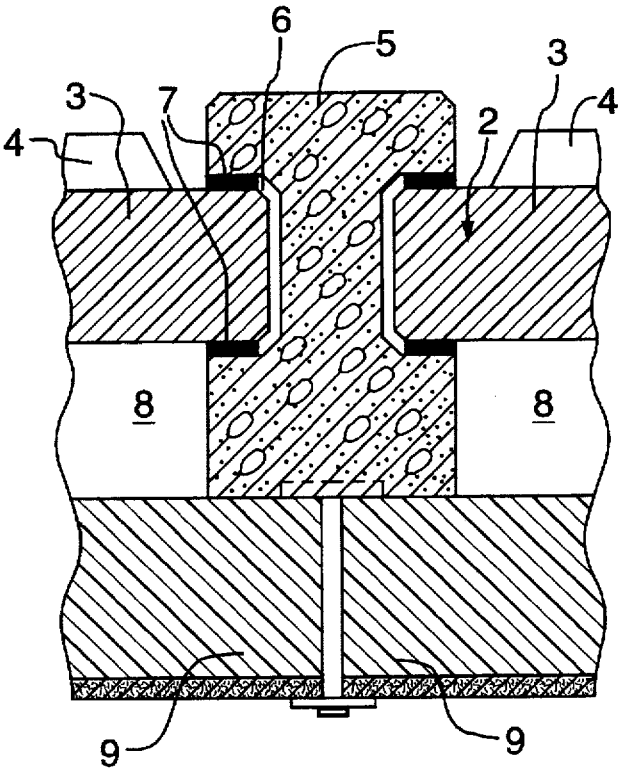
FIG. 3 shows the detail III of FIG. 2 on a larger scale.
Figure 2:
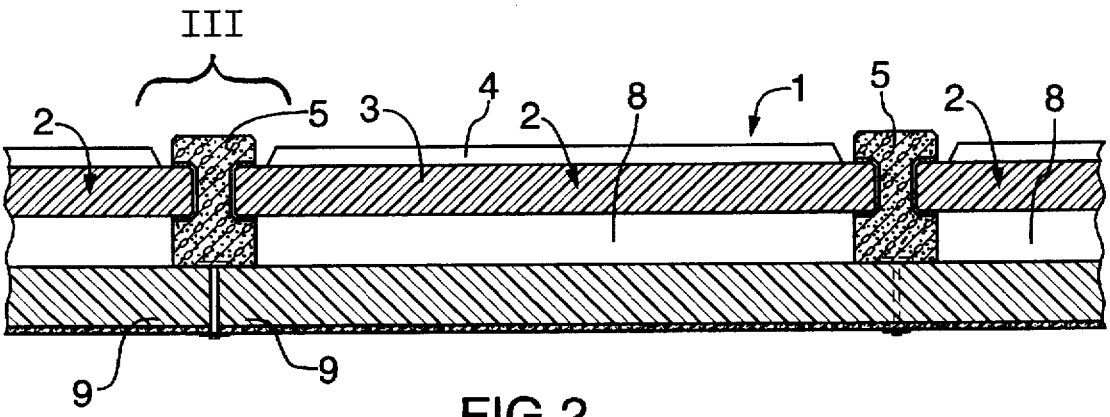
FIG. 2 is a horizontal section of part of the noise-protection screen as in FIG. 1.

In FIGS. 1 and 2 a noise-protection screen 1 is shown in vertical and horizontal section respectively. The noise-protection screen 1 is provided with sound-damping elements 2, their whole thickness being built up of wood fibre concrete. By using suitable wood fibre a sound-damping element of the required strength is obtained and it is possible to fabricate eiements that can span up to about 3 m. The sound-damping elements 2 of the embodiment shown in the drawing have a length of 2 m and a hight of 60 cm. Naturally other dimensions are also possible.

The sound-damping element is comprised of a basic part 3 onto which profile ribs 4 are mounted. The thickness of the basic part 3 is 15 cm, the thickness of the profile ribs 4 is 5 cm. Again, other dimensions and also other profile forms are possible, depending on the requirements.

The noise-protection screen 1 further comprises girders 5 which are placed at a distance from each other over the length of the noise-protection screen 1. The short sides of the sound-damping elements 2 are slid into slots 6 of the girders 5, so that the girders 5 provide a support for the sound-damping elements 2. Between the slot walls and the sound-damping elements 2 rubber strips 7 are provided.

The noise-protection screen 1 further comprises an air cavity 8 which is delimited at one side by the sound-damping elements 2 and at the other side by the panel-like elements 9. The dimensions of these panel-like elements 9 are in the present embodiment 400×50×20 cm. Naturally, here as well other dimensions are possible. In the present embodiment example elements are applied which are composed of mineralized wood fibre concrete and a compression layer of reinforced concrete. Alternatively the panels 9 may be executed as single or double sided sound-damping elements. Another alternative is that also the whole thickness of the panels 9 is built up of wood fibre concrete. The panels 9 are fastened to the girders 5 as shown in the drawing.

Depending on the requirements to be met it is possible to provide the sound-damping elements with an internal reinforcement.

In the embodiment example shown, the air cavity 8 is 15 cm deep. Depending on the circumstances the air cavity may also have a different depth.

The present noise-protection screen 1 shows a vertical height of three sound-damping elements 2 placed on top of each other. Between two successive sound-damping elements 2 distance pieces 10 are provided leaving an air gap between the elements 2. These air gaps can, for instance, be 15–60 mm. At the top the noise-protection screen is closed by a cover 11 which is also separated by an air gap from the top sound-damping element 2 with the aid of distance pieces 10. Further, between the lowest elements 2, and a not represented foundation, distance pieces 10 are provided, so that here again an air gap is provided.

At the side of the sound source the air cavity 8 is in contact with the surroundings by means of air gaps 10, so that the air cavity acts as a resonator. By the appropriate choice of the dimensions of the air cavity 8 and the air gaps 10 the sound absorption can be adjusted to the desired frequency range.

During tests with the noise-protection screen 1 as described, excellent sound-damping properties have been measured, especially in the low frequency range, as a result of the air cavity acting as resonator. The use of sound-damping elements of which the whole thickness is built up of wood fibre concrete has also the advantage that the elements can be fabricated at lower costs, and that the whole thickness of the sound-damping element consists of sound absorbing material.

Depending on the requirements to be met by the sound-damping properties, the noise-protection screen may be fabricated exclusively from sound-damping elements 2.

It should be noted that the noise-protection screen is based on a suitable foundation. The foundation itself is not part of the invention and is not further described herein.

Although the sound-damping material used in the above described embodiment example is wood fibre concrete, it is naturally possible to use other sound-damping materials.

The invention is not limited to the embodiment examples described above, they may be varied in many different ways within the scope of the invention.

I claim:

1. A noise-protection screen provided with a number of sound-damping elements and over the length of the noise-protection screen, spaced at a distance from each other with girders for the support of the elements, characterized in that the noise-protection screen comprises an air cavity delimited at one side by the sound-damping elements and at the other side by panel-like elements, said air cavity being in contact with the surroundings by means of air openings, preferably in the form of air gaps running longitudinally along the noise-protection screen; with the vertical height being provided with two or more sound-damping elements placed on top of each other, whereby between two adjacent sound-damping elements, an air gap is provided; and, said air cavity being closed off at the top by a cover member.

2. A noise-protection screen according to claim 1, characterized in that between the cover member and the adjacent sound-damping panel an air gap is provided.

3. A noise-protection screen according to claim 2, characterized in that beneath the lowest sound-damping element an air gap is provided.

4. A noise-protection screen according to claim 3, characterized in that the whole thickness of each sound-damping element is built up of wood fibre concrete.

5. A noise-protection screen according to claim 4, characterized that the panel-like elements are executed in the form of single or double sided sound-damping elements.

6. A noise-protection screen according to claim 5, characterized in that the panel-like elements are executed as sound-damping elements of which the whole thickness is built up of wood fibre concrete.

7. A noise-protection screen according to claim 6, characterized in that the girders at the same time support the panel-like elements.

* * * * *

UNITED STATES PATENT AND TRADEMARK OFFICE

CERTIFICATE OF CORRECTION

PATENT NO. : 5,713,161

DATED : February 3, 1998

INVENTOR(S) : Arend Johan Veldhoen

It is certified that error appears in the above-indentified patent and that said Letters Patent is hereby corrected as shown below:

ON THE COVER PAGE, item [56],

Insert the following into the list of "References Cited":

Under the heading "U.S. Patent Documents", insert,
--4,095,669 6/1978 Bond..181/210--;

Insert the heading -- Foreign Patent Documents--;

Under the heading "Foreign Patent Documents", insert,
--0417049A1 03/1991 EPO .....E01F 8/00--.

Signed and Sealed this

Twenty-third Day of June, 1998

Bruce Lehman

*Attest:*

BRUCE LEHMAN

*Attesting Officer*

*Commissioner of Patents and Trademarks*